US005364578A

United States Patent [19]

Grau

[11] Patent Number: 5,364,578

[45] Date of Patent: Nov. 15, 1994

[54] AN IMPROVED COMBINATION COUNTER ROTATING PACKERHEAD AND VIBRATOR ASSEMBLY AND METHOD OF OPERATION THEREOF

[75] Inventor: Thomas D. Grau, South Sioux City, Nebr.

[73] Assignee: International Pipe Machinery Corp., Sioux City, Iowa

[21] Appl. No.: 980,398

[22] Filed: Nov. 23, 1992

[51] Int. Cl.[5] ..... B28B 21/28

[52] U.S. Cl. ..... 264/71; 264/312; 425/262; 425/427; 425/430; 425/432; 425/434; 425/456; 425/457

[58] Field of Search ..... 425/262, 424, 427, 456, 425/457, 429, 430, 432, 434; 264/71, 312

[56] References Cited

U.S. PATENT DOCUMENTS

| | | | |
|---|---|---|---|
| 3,096,556 | 7/1963 | Woods | 425/262 |
| 3,276,091 | 10/1966 | Pausch | 425/262 |
| 3,733,163 | 5/1973 | Hermann | 425/262 |
| 3,752,626 | 8/1973 | Trautner et al. | 425/262 |
| 4,041,118 | 8/1977 | Ottmann et al. | 425/427 |
| 4,238,177 | 12/1980 | Crile et al. | 425/424 |
| 4,253,814 | 3/1981 | Christian | 425/427 |
| 4,340,553 | 7/1982 | Fosse | 425/262 |
| 4,540,539 | 9/1985 | Crawford et al. | 425/262 |
| 4,690,631 | 9/1987 | Haddy | 425/262 |
| 4,756,861 | 7/1988 | Schultz | 425/427 |
| 4,957,424 | 9/1990 | Mitchell et al. | 425/262 |
| 5,080,571 | 1/1992 | Crawford | 425/427 |
| 5,147,196 | 9/1992 | Adly | 425/262 |
| 5,167,967 | 12/1992 | Adly | 425/262 |

*Primary Examiner*—Jay H. Woo
*Assistant Examiner*—Joseph Leyson
*Attorney, Agent, or Firm*—Baker & McKenzie

[57] ABSTRACT

An improved combination counter rotating packerhead and vibrator assembly is provided. A counter rotating packerhead including counter rotating roller assemblies, longbottom assemblies or a combination thereof is disposed directly over an annular pneumatic vibrator. The coaxial drive shaft for the counter rotating packerhead passes through the vibrator thereby permitting the power transmission means to be located below, and isolated from, the vibrator. The vibrator is disposed below, but adjacent to, the counter rotating packerhead for faster pipe production.

18 Claims, 10 Drawing Sheets

10
11
12
13
14
15
16
17
18
19
22
23
24
25
26
27
28
29
31
32
33
34
35

Fig. 7.
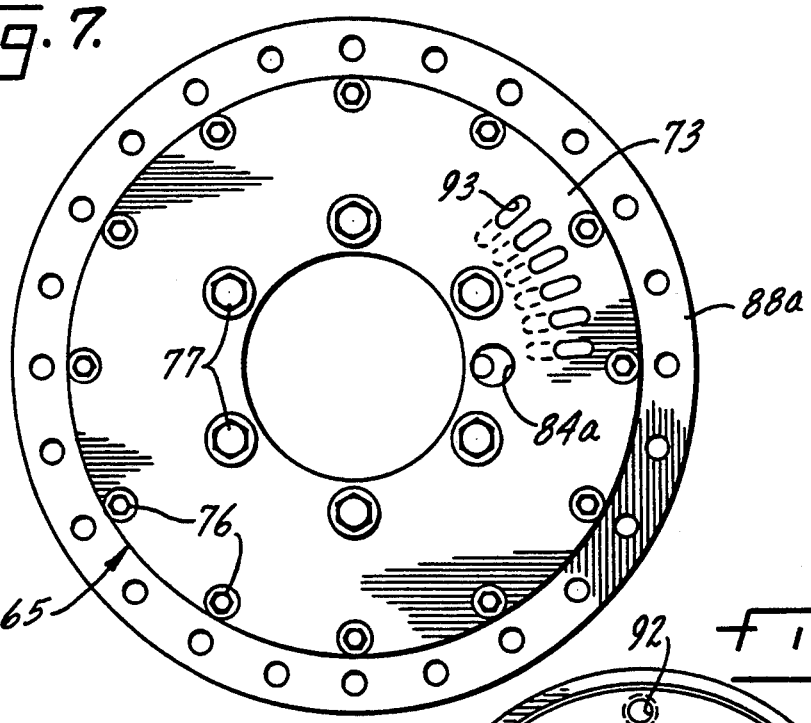
Fig. 9.
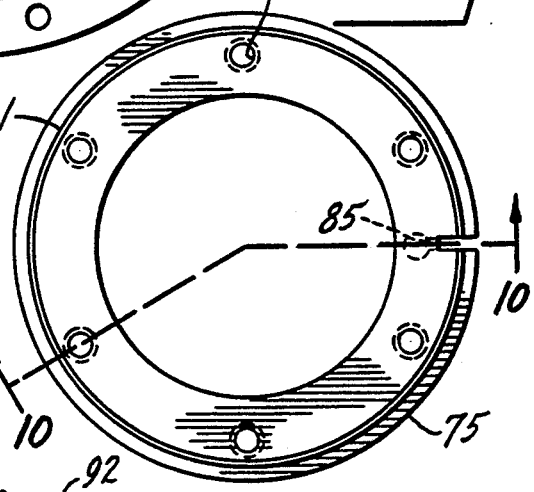
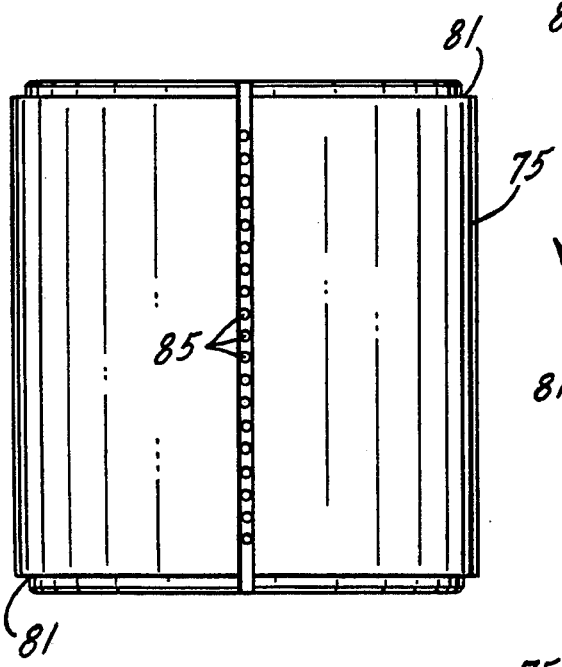
Fig. 8.
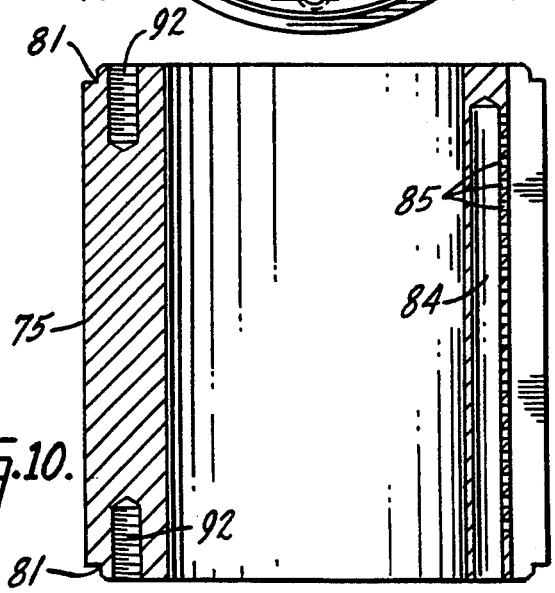
Fig. 10.

Fig.11.
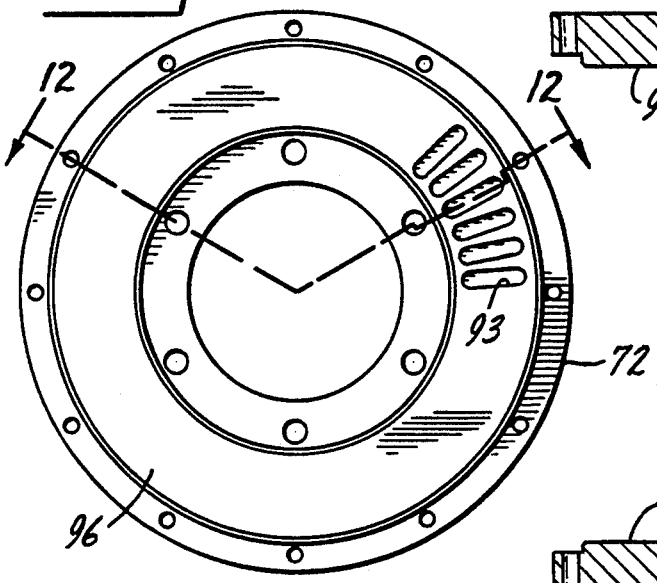
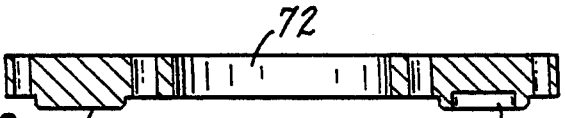
Fig.12.
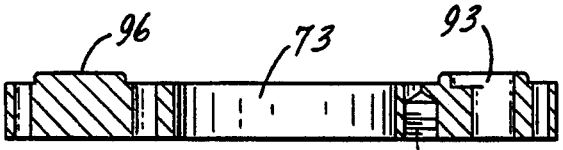
Fig.14.
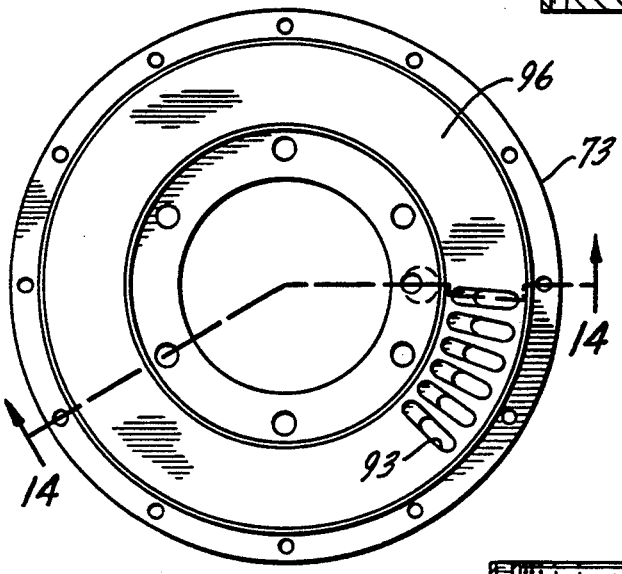
Fig.13.
Fig.15.
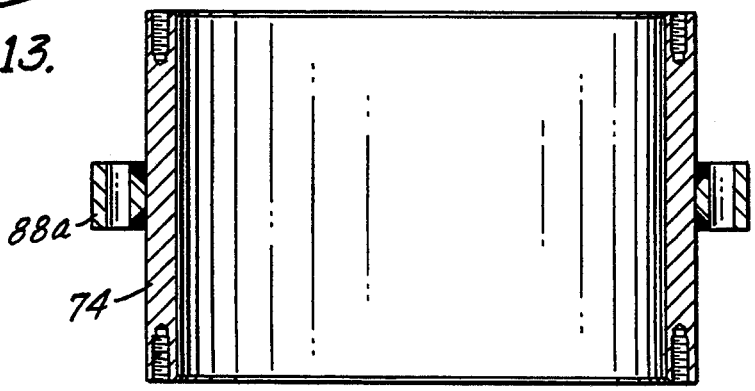

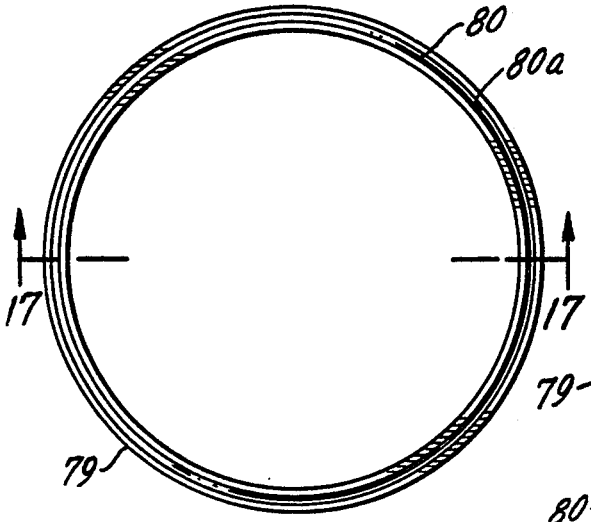
Fig. 16.
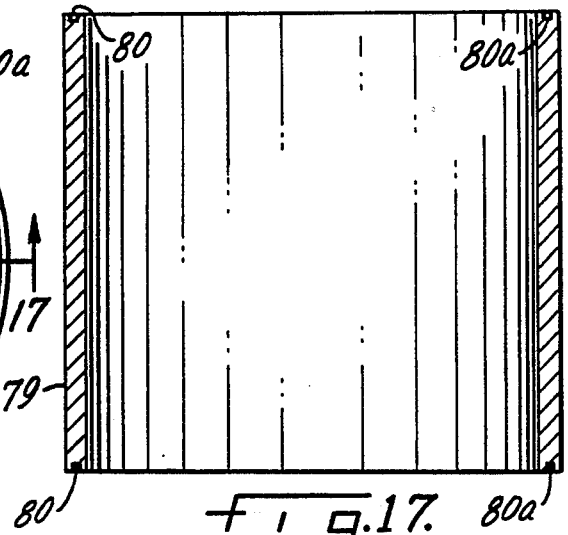
Fig. 17.
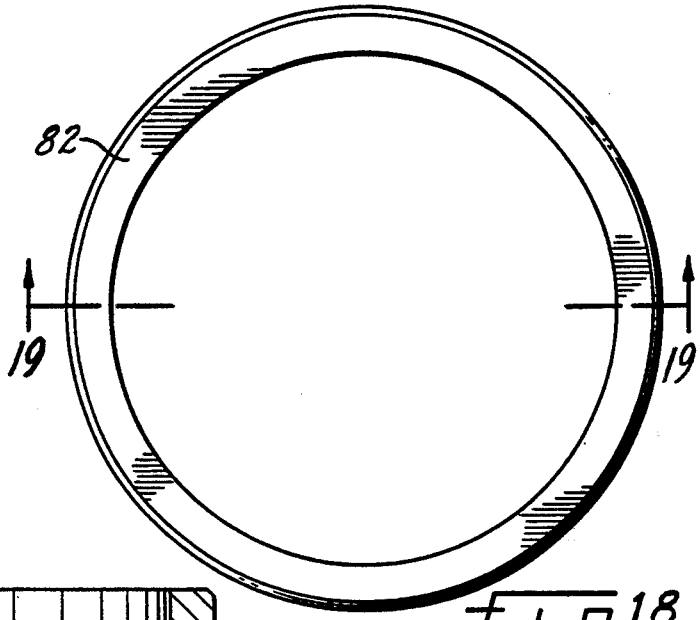
Fig. 18.
Fig. 19.
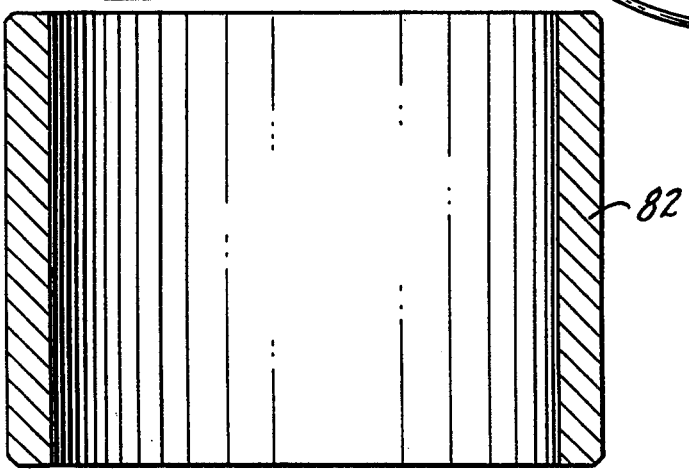

Fig. 20A.
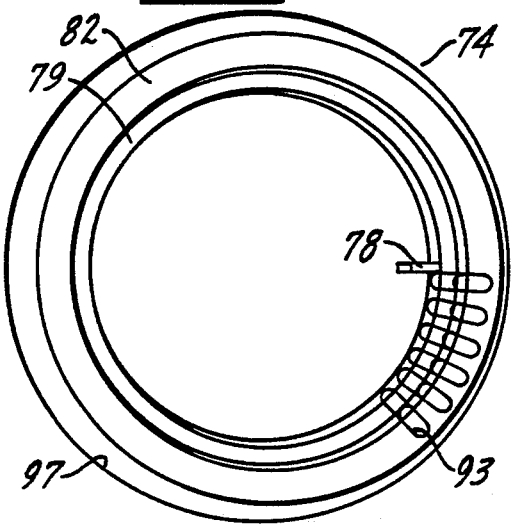
Fig. 20B.
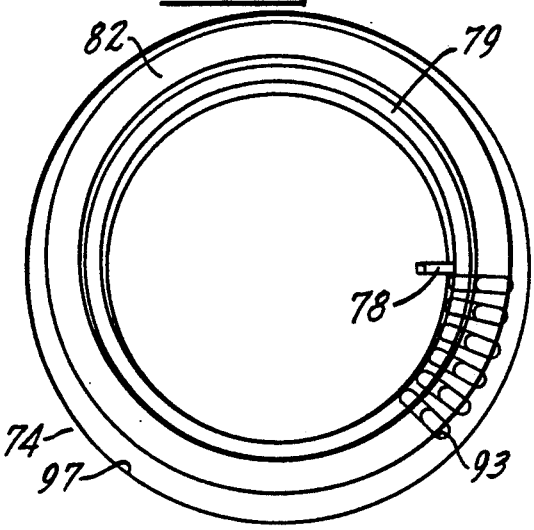
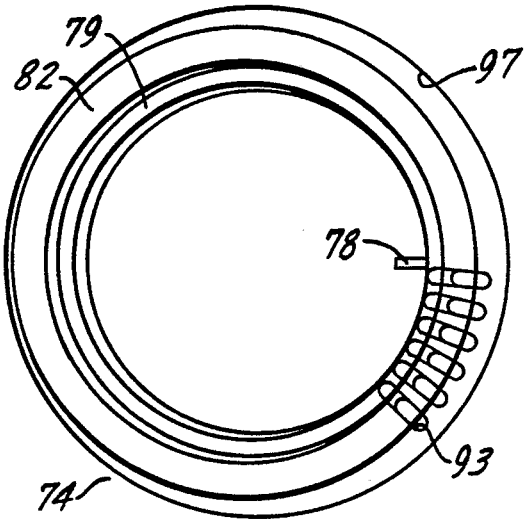
Fig. 20C.
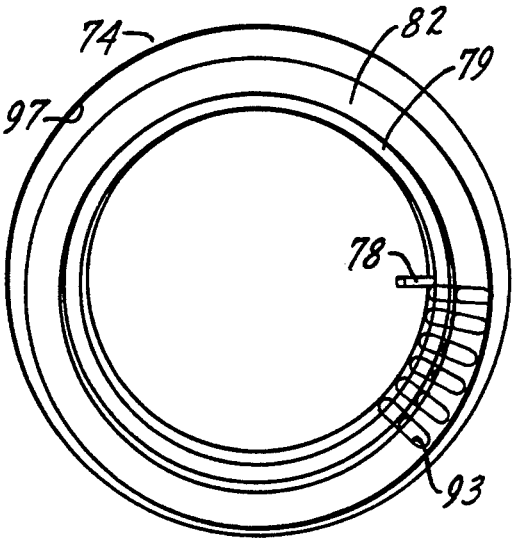
Fig. 20D.
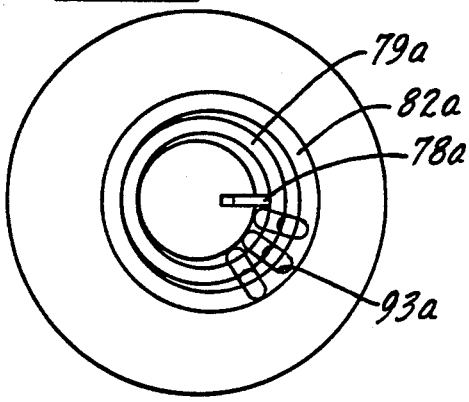
Fig. 21A.
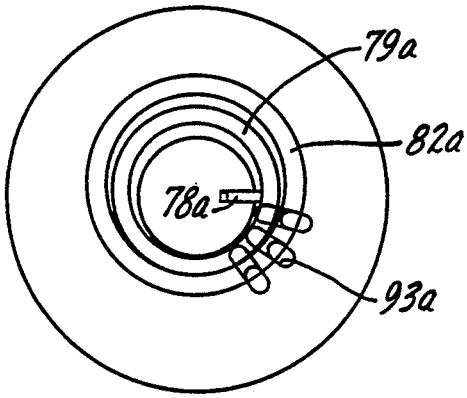
Fig. 21B.

Fig. 21C.
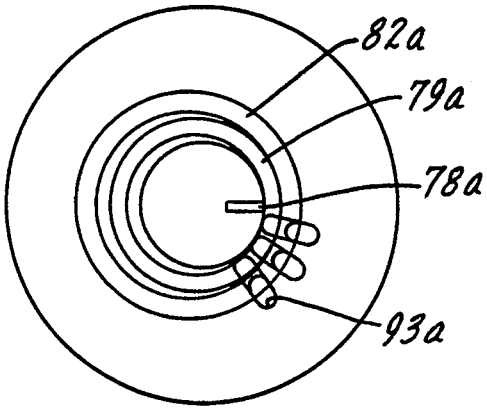
Fig. 21D.
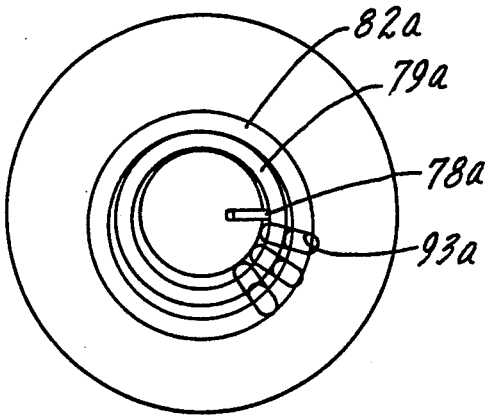
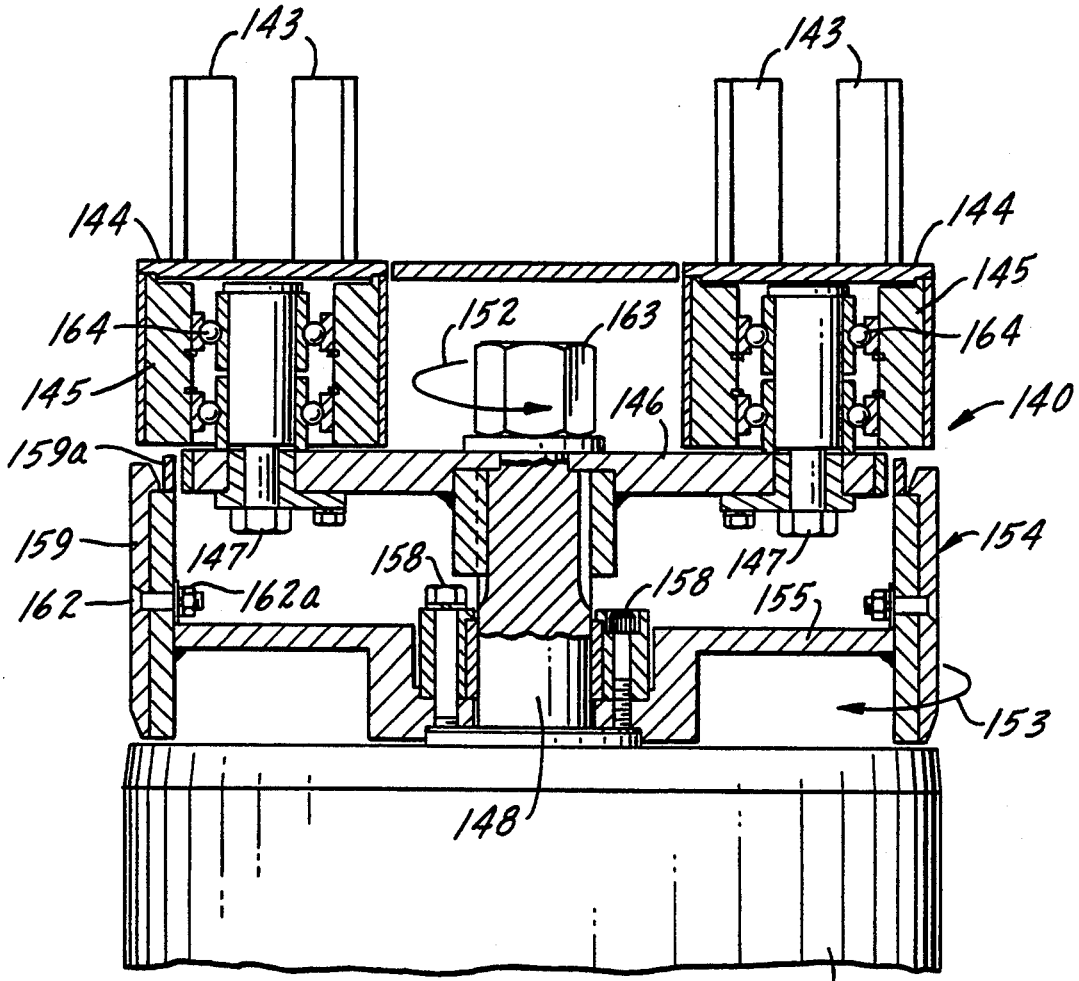
Fig. 22.

AN IMPROVED COMBINATION COUNTER ROTATING PACKERHEAD AND VIBRATOR ASSEMBLY AND METHOD OF OPERATION THEREOF

This invention relates generally to improvements in concrete pipe fabrication. More particularly, this invention relates to an improved combination packerhead and vibrating core assembly in a concrete pipe making machine and a high speed method of forming concrete pipe. The invention thus provides the benefits of a counter rotating packerhead with a vibrating core in one system.

BACKGROUND OF THE INVENTION

Counter rotating packerheads for concrete pipe making machines are known in the art. Counter rotating packerheads with a vibrator disposed below the packerhead are also known in the art. However, no design taught by the prior art effectively combines the benefits provided by counter rotating packerhead technology with vibrator technology to provide a concrete pipe making machine that produces high quality pipe at high production rates.

U.S. Pat. No. 4,540,539 discloses a counter rotating packerhead with an upper roller assembly and a lower longbottom assembly disposed below the upper roller assembly for use in dry cast pipe production. This radial distribution process is also known as concrete forming. The upper roller assembly acts to initially distribute the dry cast concrete radially outward through a wire reinforcing cage against a concrete pipe mold. After the dry cast concrete is initially pressed against the cage and mold by the upper rotating roller assembly, the lower rotating longbottom assembly further presses the dry cast concrete against the cage and mold.

The upper roller assembly and lower longbottom assembly of U.S. Pat. Nos. 4,540,539 and 5,080,571 counter rotate, that is, they are driven in opposite directions. The rotation of each assembly, if viewed without regard to the presence of the other assembly, would act, or tend to act, to impart a twist to a wire cage which is contained within the concrete structure. However, in actual operation, the imposition of the counter clockwise and the clockwise twists are occurring simultaneously and may, at any given instant in time, overlay one another with respect to the points of application of the twists to the wire cage so that the forces effectively cancel out one another at all times. The elimination of cage twist significantly improves the final product because cage twist causes voids in the concrete and voids significantly weaken the final concrete pipe product.

The problem primarily associated with counter rotating packerheads is low pipe density. Attempts to cure this defect resulted in the first combination counter rotating packerheads/vibrator concrete pipe making machines.

U.S. Pat. No. 4,957,424 discloses a counter rotating packerhead with a vibrator disposed below the packerhead. This patent is said to represent an improvement over methods of concrete pipe making that include a counter rotating packerhead only or a vibrating core only. The earlier methods that implemented vibrating cores only produced a high density concrete pipe because the vibration process is very effective in consolidating or densifying dry cast concrete. However, the vibration process is quite slow and has its own disadvantages. Further, this machine is only capable of producing one pipe at a time.

Concrete pipe making methods that employ vibrators only are subject to slumping problems unless carefully contracted. The voids and other distortions (also referred to as concrete-slumping) are primarily caused by the volume reduction of the concrete after the vibration. Vibration causes dry cast concrete to densify which results in a reduction in volume. The reduction in volume will result in void spaces around the form work, especially at or near the wire reinforcing cages.

In rising core concrete pipe making machines taught in the prior art, the density levels attainable in the pipe are limited. If the vibrational frequency is increased to too high a level, concrete-slumping, void spaces and other distortions will be present in the finished pipe. This is especially problematic in irregularly shaped pipes, such as pipes with top spigots, tongue joints and grooved gasket joints. Unsatisfactory pre-packing before vibration will cause concrete-slumping, especially in forms used to make the above-noted irregularly shaped pipes. Pre-packing using weighted forming rings has been tried but manufacturers then encounter problems with length control. If the pipe lengths and joints do not meet specifications, the pipes will be rejected.

The U.S. Pat. No. 4,957,424 states that exposing the dry cast concrete to a counter rotating packerhead and vibration combines the advantages of vibration with the speed of counter rotating packerheads. Thus, the invention disclosed in U.S. Pat. No. 4,957,424 is stated to combine two useful concrete pipe making technologies.

However, the concrete pipe making machines taught and suggested by U.S. Pat. No. 4,957,424 are not entirely satisfactory for several reasons. First, as seen in FIGS. 4 and 13 of said patent, the disclosed designs require that the vibrator be mounted below the motor that drives the counter rotating packerhead. Thus, the vibrator must be positioned substantially below the counter rotating packerhead. Because the design disclosed in U.S. Pat. No. 4,957,424 requires that the packerhead motors be disposed between the counter rotating packerhead and the vibrator, the combination of the counter rotating packerhead technology and vibrating technology is not as effective as it theoretically could be in terms of quality and speed of production.

The second and related problem associated with the design taught and suggested in U.S. Pat. No. 4,957,424 lies in the vibrator itself. The vibrator shown in FIGS. 4 and 13 are hydraulic vibrators. Because of the size of hydraulic vibrators generally, the vibrator must be disposed substantially below the lower roller assembly of the counter rotating packerhead. This placement further compromises the potential effectiveness of the general concept of combining a counter rotating packerhead with a vibrator. Ideally, strong vibrating forces should vibrate the concrete immediately after or concurrently with the application of the radially outward forming forces exerted by the counter rotating packerhead. By combining the action of the counter rotating packerhead with an immediate vibrating action, the entire pipe making process could be shortened. However, as disclosed in U.S. Pat. No. 4,957,424, the actions of the counter rotating packerhead and the vibrator are separate and distinct from one another due to the inherent structure of the hydraulic vibrator, thereby prolonging the pipe making process.

The third problem associated with the above-mentioned design can be best understood upon examination of FIG. 9 of U.S. Pat. No. 4,957,424. FIG. 9 represents an attempt to provide a compact drive system for a counter rotating packerhead to be disposed between the vibrator and counter rotating packerhead. Simply put, the two drive gears and multiple bearings disclosed in FIG. 9 are subject to the high amplitude vibrations provided by the vibrator disposed immediately beneath the motor. The result is a mechanically unreliable machine. Neither FIGS. 4 or 13 teach or suggest an isolation section to isolate the packerhead and its associated drive means shown in FIG. 9 from the vibrator. The only attempt or suggestion of isolation is provided by the plurality of shock absorbing pads mounted around the base that supports the drive means but this expedient has not been sufficient to cause the machine of U.S. Pat. No. 4,957,424 to go into use. In addition, only one pipe can be made at a time.

Thus, there is a need for an improved system in which a core vibrator may be disposed immediately below a counter rotating packerhead thereby providing a truly combined counter rotating packerhead/vibrator assembly, yet providing improved isolation from the working parts of the packerhead to a far greater degree than is presently provided. There is also a need for an improved drive shaft/drive system for a counter rotating packerhead that enables the drive means to be disposed in a remote location and isolated from the vibrator.

Still another problem associated with the prior art is the general lack of attempts to increase the rate of pipe making construction. The present invention contributes to this need in the art by providing a counter rotating packerhead assembly where the vibrator and counter rotating packerhead are disposed adjacent to one another for faster pipe making processes.

The present invention also discloses a pipe making machine with multiple cores and multiple forms so the machine makes at least two pipes of equal or different sizes at once, thereby increasing pipe productivity.

BRIEF DESCRIPTION OF THE INVENTION

The present invention makes a significant contribution to the art of concrete pipe making by providing a system and method for producing reinforced concrete pipe with a combined counter rotating packerhead and vibrator assembly which enables high speed concrete pipe making without sacrificing pipe quality. The present invention also discloses an apparatus for combining multiple pipe making assemblies on one turntable to produce multiple pipes of equal or different sizes at once in an automated process. The present invention also discloses an improved vibrator for use in concrete pipe making equipment.

The improved combined counter rotating packerhead and vibrator assembly is based upon an improved counter rotating packerhead/vibrator/drive means configuration and an improved vibrator design. The counter rotating packerhead preferably consists of an upper concrete forming assembly disposed immediately above a lower concrete forming assembly. The forming assemblies are preferably upper and lower roller assemblies but it will be understood that a longbottom assembly may be substituted for either roller assembly (or rollers) and still fall within the spirit and scope of the present invention. The upper and lower concrete forming assemblies rotate in opposite directions to eliminate cage twist.

The upper and lower concrete forming assemblies are driven by a common drive system. Power is supplied to both upper and lower concrete forming assemblies via a coaxial drive shaft system. The coaxial drive shaft extends downward from the forming assemblies through the vibrating core. Immediately below the lower concrete forming assembly is a short isolation section to protect moving parts of the lower concrete forming assembly from the vibrator and to allow the vibrating core to move independently to further densify the concrete while under pressure from the concrete forming assemblies and therefore with greater vibration efficiency.

Disposed immediately below the isolation section is the vibrator. The vibrator is of an annular configuration allowing the coaxial drive shaft system to pass directly through it. Because of the unique annular configuration of the vibrator, the means for driving the upper and lower concrete forming assemblies of the counter rotating packerhead can be mounted at a remote location below the vibrator and below the vibrator core. The preferred vibrator is of the pneumatic type having an orbiting roller or rollers. Provision can also be made to add replaceable wearing surface material to any or all of the rollers or roller surfaces.

The annularly configured vibrator includes an annular top plate and an annular bottom plate. An annular vibrator body connects the outer peripheries of the top and bottom plates while an annular vibrator shaft connects the inner peripheries of the top and bottom plates. The annular space, bound by the top and bottom plates, the body and the shaft, houses an outer cylindrical roller, an inner cylindrical roller and an impeller vane. The vane is disposed within the inner cylindrical roller. It should be understood however that it is feasible in some cases to run with a single rotating cylinder.

The annular shaft contains a conduit that establishes fluid communication between a pressurized fluid source and the vane. Pressurized fluid contacts the vane through the vibrator shaft and the vane induces an eccentric circular rotation of the inner and outer cylindrical rollers, thereby causing the annular vibrator body to vibrate. The vibrator body transmits vibrations to the core skin to which the vibrator is rigidly mounted which in turn transmits the vibrations to the dry cast concrete. This results in denser, higher quality concrete pipe. The preferred pressurized fluid is air.

The above-noted configuration provides a superior concrete pipe making machine for the following reasons. The upper and lower concrete forming assemblies apply radially outward forces to the concrete which results in pressure being applied to the concrete in the outward, upward and downward directions. The downward pressure exerted by the upper concrete forming assembly is counteracted by the upward pressure exerted by the lower concrete forming assembly. This action results in dense, pre-packed concrete.

The downward forces exerted by the lower concrete forming assembly are immediately combined with and counteracted by the vibrating action of the vibrator which, in accordance with the present invention, is disposed immediately below the lower concrete forming assembly on the lower side of the isolation section. In general, the concrete is not vibrated until it has been pre-packed by the upper and lower concrete forming assemblies and therefore the additional densifying action attributable to the vibration does not result in significant volume reduction or concrete-slumping that leads to voids in the finished product. It will be understood that a typical material used in the manufacture of concrete pipes is zero or very low slump concrete.

The improved combination counter rotating packerhead and vibrating core assembly of the present invention also lends itself to an improved method of manufacturing concrete pipe.

First, the assembly enters a lower end of the reinforcing wire cage located within a concrete pipe mold. Computer controlled equipment feeds dry cast concrete down through an upper end of the mold and cage. The upper concrete forming assembly (preferably an upper roller assembly) applies a radially outward force to the concrete, thereby pressing the concrete outward through the cage and against the mold as well as upward and downward. The lower concrete forming assembly (either a lower roller assembly or a lower longbottom assembly) applies a second radially outward force against the dry cast concrete further condensing and pressing the concrete through the cage and against the mold. The concrete pushed upward by the lower concrete forming assembly collides with and is prepacked with the concrete that is being pushed downward by the upper concrete forming assembly. As the assembly proceeds upward, the vibrating core then vibrates the dry cast concrete almost simultaneously with the downward pressure action of the lower roller or longbottom assembly further consolidating and densifying the dry cast concrete.

The combination of the counter rotating packerhead immediately followed by strong vibrational forces produces concrete pipe with higher densities and produces the denser pipe at rates equal to or faster than previously known concrete pipe making methods. The combination provided by the present invention also alleviates the problems of voids in the concrete and concrete-slumping which have been previously attributable to the densification (consolidation) action of the vibrator.

It is therefore an object of the present invention to provide an improved combination counter rotating packerhead and vibrating core assembly for manufacturing concrete pipe.

Another object of the present invention is to provide an improved counter rotating packerhead and vibrating core assembly with two counter rotating roller assemblies for manufacturing concrete pipe.

Yet another object of the present invention is to provide an improved combination counter rotating packerhead and vibrating core assembly with one rotating roller assembly and a counter rotating longbottom assembly or, alternatively, two counter rotating longbottom assemblies for manufacturing concrete pipe.

Another object of the present invention is to provide an improved annularly configured vibrator for use in concrete manufacturing machines.

Still another object of the present invention is to provide an improved pneumatic vibrator that enables roller assembly drive shafts or other means of power transmission to bypass it, thereby enabling the vibrator to be disposed immediately below the counter rotating packerhead.

Yet another object is to provide an improved pneumatic vibrator that enables roller assembly drive shafts or other means of transmission to by-pass it whereby the vibrator may be centrally located with respect to the mold and pipe in formation, all of which results in uniform vibration. It will be understood that if the vibratory forces are not evenly and uniformly imparted to the concrete, the compaction pattern will be uneven and the goal of equal concentricity of vibrations induced in the concrete will not be attained.

Another object of the present invention is to provide an improved concrete fabricating machine that automatically manufactures two pipes at once.

Still another object of the present invention is to provide a faster method of making quality concrete pipe than known before.

BRIEF DESCRIPTION OF THE DRAWINGS

This invention is illustrate more or less diagrammatically in the accompanying drawing, wherein:

FIG. 7 is a bottom view of the vibrator assembly shown in FIG. 3;

FIG. 8 is a side elevational view of the vibrator shaft of the vibrator assembly;

FIG. 9 is a top end view of the vibrator shaft shown in FIG. 8;

FIG. 10 is a sectional view taken substantially along line 10—10 of FIG. 9;

FIG. 11 is a bottom view of the top plate of the vibrator shown in FIG. 3;

FIG. 12 is a section taken substantially along line 12—12 of FIG. 11;

FIG. 13 is a top view of the bottom plate of the vibrator assembly shown in FIG. 3;

FIG. 14 is a sectional view taken substantially along line 14—14 of FIG. 13;

FIG. 15 is a sectional view of the vibrator body of the vibrator assembly shown in FIG. 3;

FIG. 16 is an end view of the inner roller of the vibrator assembly shown in FIG. 3;

FIG. 17 is a sectional view taken substantially along line 17—17 of FIG. 16;

FIG. 18 is an end view of the outer roller of the vibrator assembly shown in FIG. 3;

FIG. 19 is a sectional view taken substantially long line 19—19 of FIG. 18;

FIGS. 20A–20D are diagrammatic end views of the vibrator assembly illustrating the rotation of the inner and outer rollers;

FIGS. 21A–21D are diagrammatic end views illustrating the motion of the inner and outer rings of a modified vibrator assembly;

FIG. 22 is a partial sectional view showing a counter rotating packerhead with an upper roller head and lower longbottom assembly made in accordance with the present invention;

DETAILED DESCRIPTION OF THE INVENTION

Figure 1:
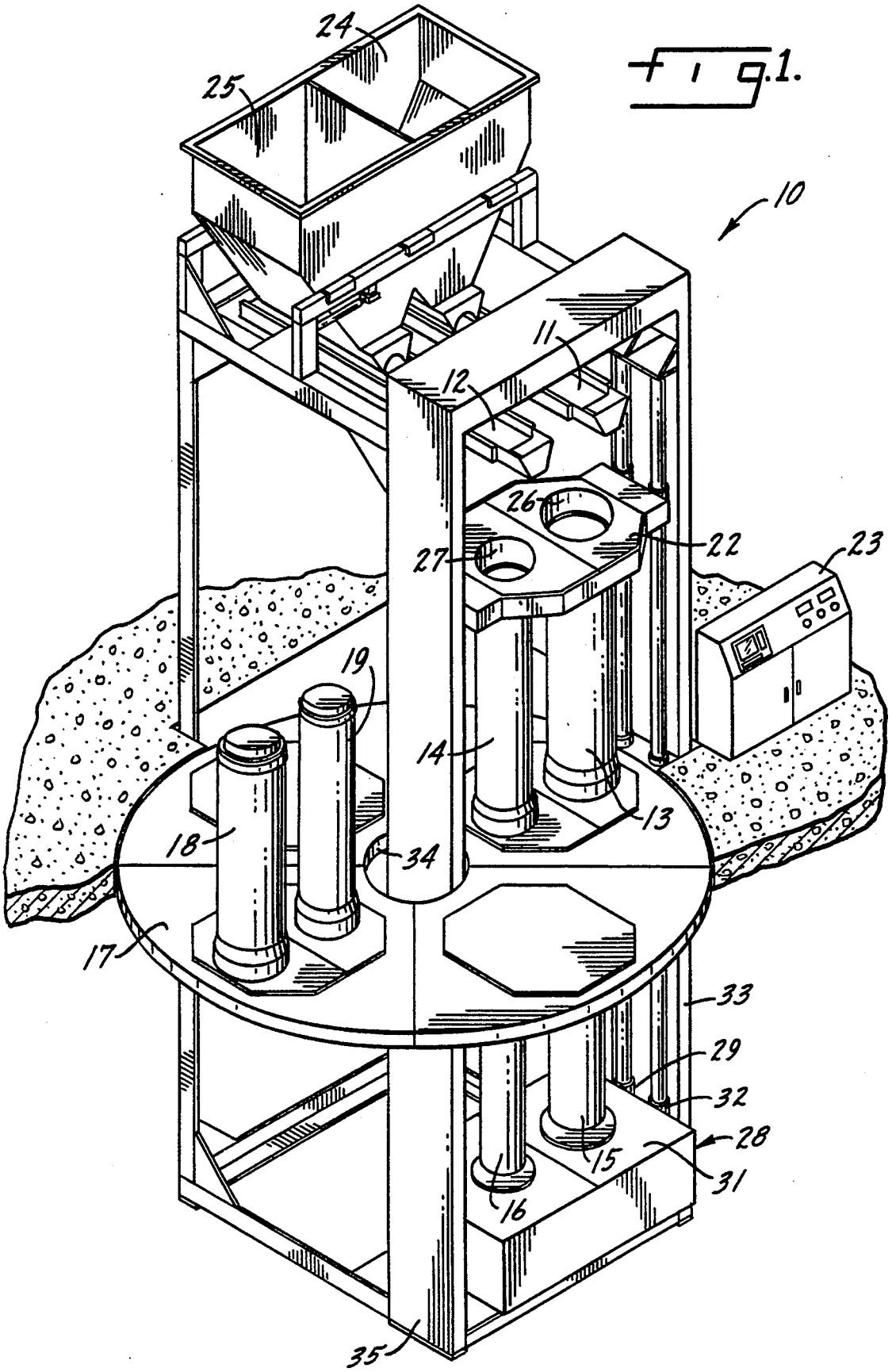
FIG. 1 is a perspective view of a concrete pipe making machine constructed in accordance with the present invention.

Like reference numerals will be used to refer to like or similar parts from Figure to Figure in the following description of the drawings.

Referring first to FIG. 1, a concrete pipe making machine is indicated generally at 10. The machine includes dual feed conveyors 11, 12, dual pipe molds 13, 14 and dual cores 15, 16. After two pipes are fabricated in molds 13, 14, the turntable 17 is rotated 90, 180 or 270 degrees so that two additional molds 18, 19 are placed under the platform 22 and the process is begun again. The entire process is automated and controlled via the automation control panel 23.

Initially, concrete contained in the hoppers 24, 25 flows down through the conveyors 11, 12, and then through the holes 26, 27 in platform 22 into the molds 13, 14. The cores 15, 16 are mounted on a horizontal lift platform as indicated generally at 28 and the horizontal lift platform 28 is raised upward as the cores 15, 16 traverse through the molds 13, 14. The upper surface 31 of the lift platform 28 engages the underside (not shown) of the turntable 17 after the pipes have been fabricated inside the molds 13, 14. Hydraulic cylinders 29, 32 raise and lower the horizontal lift platform 28. The hydraulic cylinders 29, 32 are attached to right frame member 33. Left frame member 35 serves as an axis for rotation of the turntable 17, the axis being coaxial with the axis of the central hole 34 of turntable 17.

Figure 2:
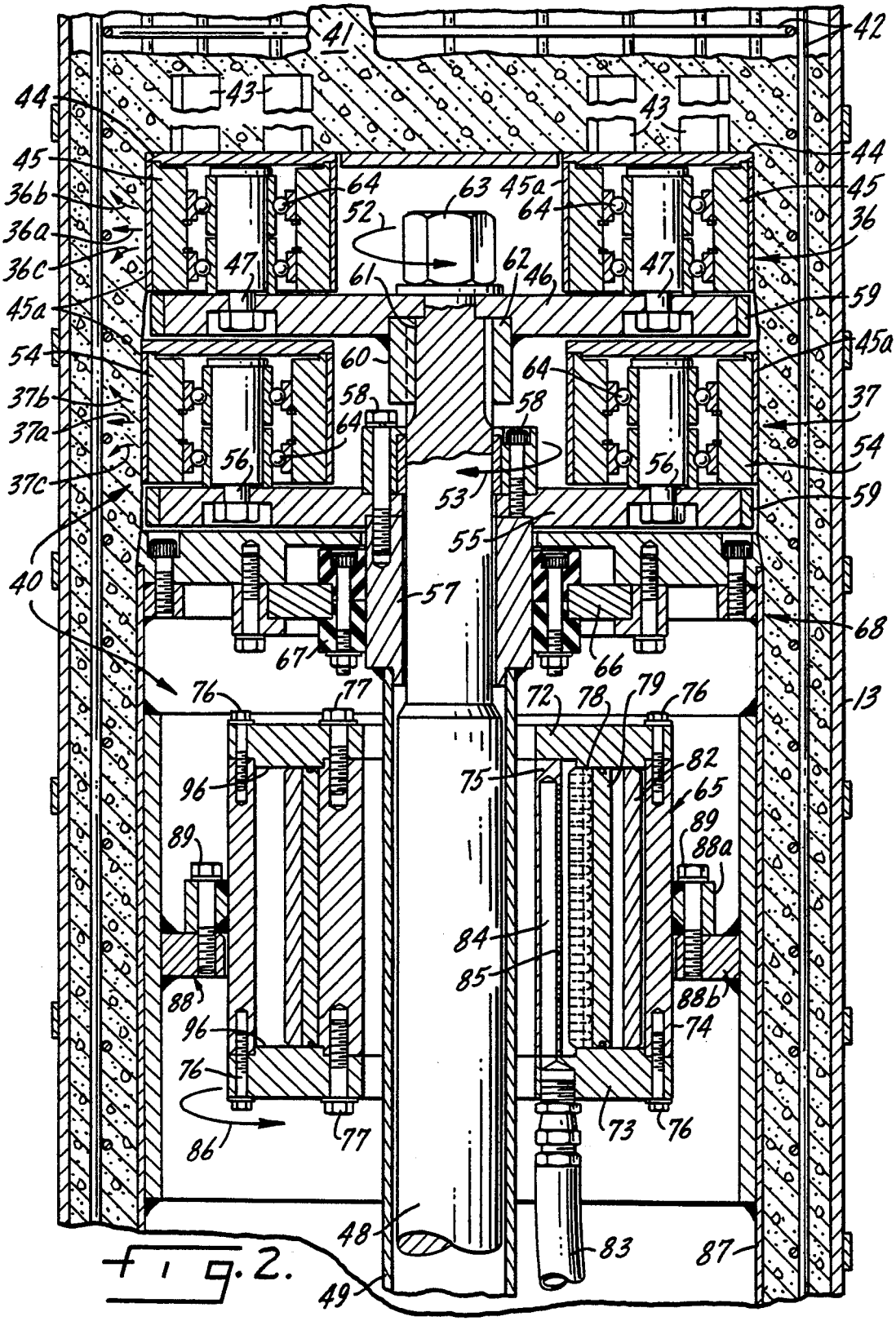
FIG. 2 is a partial sectional view taken through the core of a concrete pipe making machine constructed in accordance with the present invention particularly showing the dual counter rotating packerhead and annular vibrator.

Turning to FIG. 2, the action of a combination counter rotating packerhead and vibrator assembly is indicated generally at 40. The assembly is illustrated inside a mold, indicated at 13. Concrete 41 is supplied downward from a conveyor, such as 11 (see FIG. 1). The mold 13 is equipped with a reinforcing cage 42.

As concrete 41 is deposited on top of the assembly 40 it is pushed circumferentially outwardly by upwardly protruding paddles or fins, shown at 43. At least two fins 43 are mounted to the upper plate 44 of each upper roller 45 in upper roller assembly 36. Each upper roller 45 is rotatably mounted to the base plate 46 by a bolt 47. The base plate 46 is fixedly attached to the inner drive shaft 48 by the head nut 63. The upper base plate 46 is locked to the inner drive shaft 48 by a hub 62 having an integral key 60 which meshes with the spline 61 on the upper end of shaft 48.

The inner drive shaft is turned in the direction of the arrow 52 by a drive means or motor located beneath the lift platform 28 (not shown). As will be noted below, the outer drive shaft 49 is rotated in the direction of the arrow 53, which is in a direction opposite to the inner drive shaft 48, by a drive means located beneath left platform 28 (see FIG. 1) to provide the counter rotating action.

The lower roller assembly, indicated generally at 37, includes rollers 54 which are rotatably attached to a base plate 55 by bolts 56. The base plate 55 is connected to the outer drive shaft 49 by attachment to the circular sleeve 57 which is in turn welded to the upper end of outer drive shaft 49. The base plate 55 is mounted to the sleeve 57 by bolt 58.

The upper roller assembly, indicated generally at 36, includes the upper rollers 45 and the lower roller assembly, indicated generally at 37 includes the lower rollers 54 which are all mounted to the posts or bolts 47, 56 respectively with a plurality of bearings, shown generally at 64. Each base plate 46, 55 is equipped with an outer abrasion resistant member, shown generally at 59. The rollers 45 may be equipped with an outer coating of replaceable wear material 45*a*. Suitable replacement wear materials will be apparent to those skilled in the art.

Another aspect of the invention resides in the isolation of the roller assemblies 36 and 37 from the vibrator 65. This is primarily accomplished by the isolation section 68 that includes a bearing 66 mounted on rubber bushings 67 to mechanically isolate the roller assemblies 36, 37 from the vibrator 65. As best seen in FIG. 2, it will be noted that the vibrator 65, despite being isolated from the lower rollers 54, is still disposed essentially immediately below the lower rollers 54.

The vibrator 65 consists of an annular top plate 72 and an annular bottom plate 73 which are connected one to the other by an annular vibrator body 74, see also FIG. 15, at the outer peripheries of the top plate 72 and bottom plate 73 via a plurality of bolts, shown generally at 76. Further, the annular top plate 72 and the annular bottom plate 73 are connected at the inner peripheries thereof by a vibrator shaft 75, see also FIG. 10, and the bolts 77. The annular space bound by the top plate 72, the bottom plate 73, the body 74 and the shaft 75 contains a vane, indicated generally at 78 (see FIGS. 4–7), an inner roller 79 and an outer roller 82.

The vibrator 65 shown in FIG. 2 is a pneumatic vibrator that is driven by air or another suitable fluid supplied through the hose 83 which is connected to a pressurized fluid supply (not shown). Air enters through the hose 83, through the conduit 84 in shaft 75, and through the small drilled holes 85 in the vibrator shaft 75. After passing through the small drilled holes 85, the air engages the vane 78 which in turn drives the inner roller 79 and the outer roller 82 in a rotating fashion indicated by the arrow 86. Durable O-rings or other sealing means 80 may be disposed in the grooves 80*a* disposed in the upper and lower ends of the inner roller 79 to inhibit the leakage of air as air and the vane 78 engage the inner roller 79. The O-ring 80, quad-ring 80 or other sealing means 80 should be comprised of a durable material such as a phenolic resin or other suitable gasket material that is durable. The rotation indicated at 86 imparts vibration to the vibrator body 74 which is imparted to the core skin 87 through the brackets shown generally at 88. The upper half-bracket 88*a* is mounted to the vibrator body 74 while the lower half-bracket 88*b* is mounted to the inside of the core skin 87. The upper and lower bracket halves are connected by a plurality of bolts 89. It will be emphasized that the vibrator 65 is mechanically isolated from the upper and lower roller assemblies 36, 37 (or the upper and lower concrete forming assemblies 36, 37). As seen in FIGS. 2 through 21D, the vibrator 65 contains no bearings.

Thus, the combination counter rotating packerhead and vibrator assembly 40 first applies radially outward, upward and downward forces on the concrete 41 by the action of the upper rollers 45 (or upper concrete forming assembly 36) as indicated by arrows 36*a*, 36*b*, 36*c* respectively as the upper rollers 45 rotate in the direction of the arrow 52. The action of the upper rollers 45 pushes the concrete 41 through the cage 42 and against the mold 13. The cage 42 is simultaneously urged or twisted in the direction of arrow 52 due to the mass, velocity and direction of movement of the concrete.

Immediately thereafter, and as the assembly 40 proceeds upwardly, the lower rollers 54 (or lower concrete forming assembly 37) impart additional radially outward, upward or downward forces on the concrete 41 as indicated by arrows 37*a*, 37*b* and 37*c* respectively further pressing it through the cage 42 and against the mold 13. The mass, velocity and direction of movement of the concrete exerts a twisting force on the cage in the direction of the arrow 53 which substantially or entirely counteracts the twist imparted to the cage by the upper roller assembly 36 as indicated by the arrow 52. The downward forces 36*c* of the upper rollers 45 counteract the upward forces 37*b* of the lower rollers 54 thereby effectively pre-packing the concrete prior to vibration. As the assembly 40 proceeds upward, the concrete 41 in general and especially the concrete being pushed in the direction of arrow 37*c* is contemporaneously and immediately subjected to vibrations from the vibrator 65 through the core skin 87.

Figure 3:
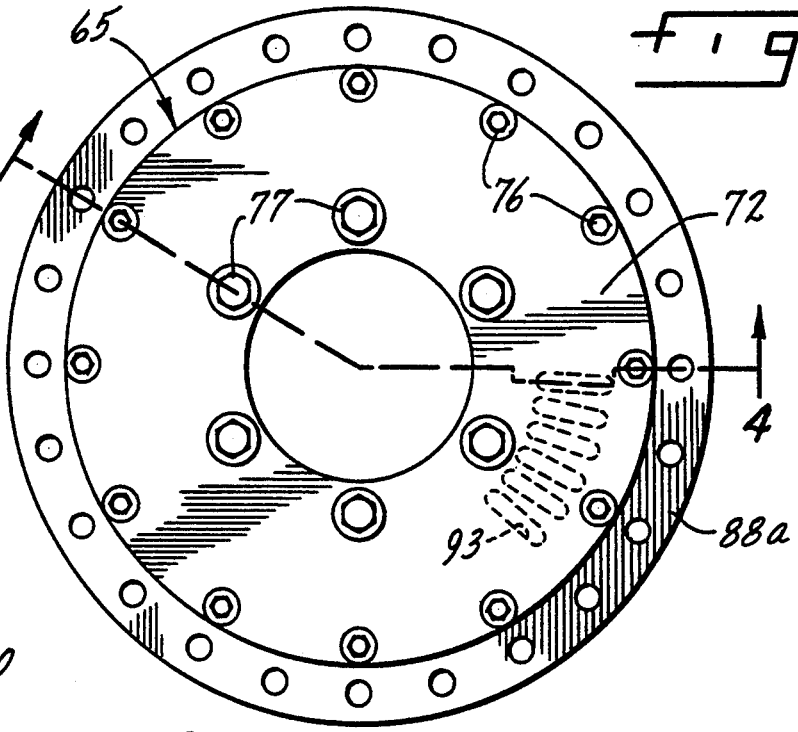
FIG. 3 is a top plan view of the vibrator assembly constructed in accordance with the present invention.

It will be noted that an important benefit of the present invention is the location of the vibrator 65 almost directly beneath the lower rollers 54 so as to impart vibratory forces to the dry cast concrete 41 immediately after it has been displaced radially outward through the cage 42 and against the mold 13 by the upper rollers 45 and lower rollers 54. This preferred arrangement is accomplished by providing a vibrator that is driven by a motive fluid which requires a space only sufficient to accommodate a motive fluid power supply conduit. As seen in FIGS. 2 and 3, the solid and hollow drive shafts 48, 49 pass through the annulus of the vibrator 65.

FIGS. 4–7 illustrate of the construction and operation of the vibrator 65 in greater detail. The top plate 72, the bottom plate 73, the body 74 (see also FIG. 15) and the shaft 75 (see also FIG. 10) define an annular area that contains the vane 78, the inner roller 79 and the outer roller 82. Air enters from the air hose 83 (shown in FIG. 2), through the inlet 84*a* into the conduit 84 drilled within the wall of the shaft 75. Air then passes through the small drilled holes, shown generally at 85, and engages the vane 78. The action of the air against the vane 78 causes rotation of the inner roller 79 and outer roller 82 in a circular fashion indicated by the arrow 86 shown in FIG. 2. Since half-bracket 88*a* connects the vibrator 65 to the core 87 (see FIG. 2) the vibratory impulses generated by vibrator 65 are imparted to the freshly pre-packed concrete disposed between the mold 13 and the core skin 87.

Figure 5:
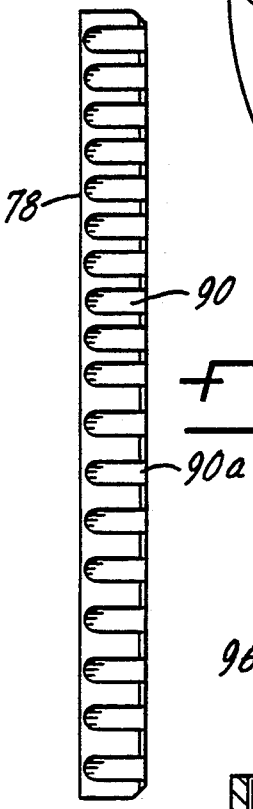
FIG. 5 is an elevational view of the vane used in the vibrator of the present invention.
Figure 4:
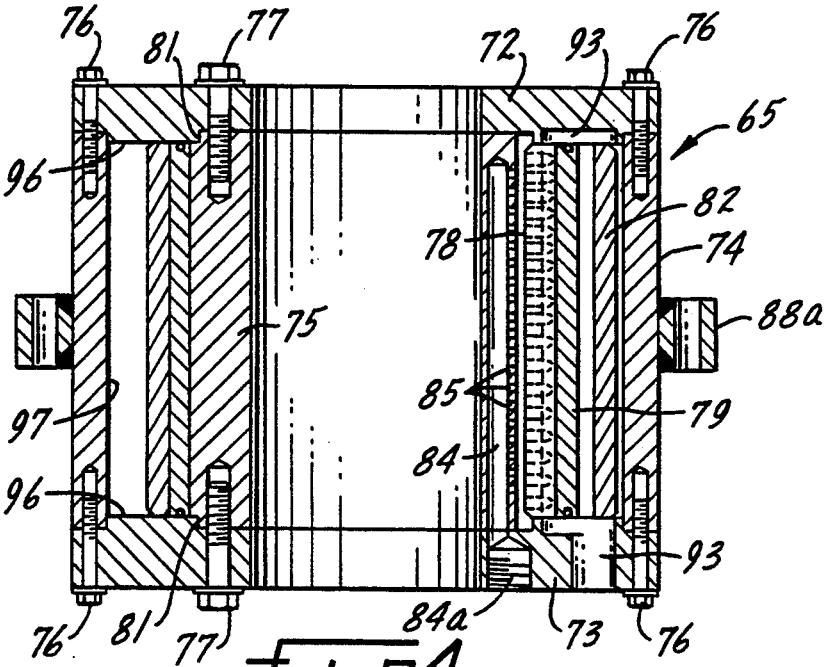
FIG. 4 is a sectional view taken substantially along line 4—4 of FIG. 3.
Figure 6:
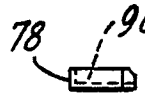
FIG. 6 is an end view of the vane shown in FIG. 5.

FIGS. 5 and 6 are detailed illustrations of the vane 78. The vane 78 is preferably made of phenolic bonded canvas with a series of slots 90 disposed therein. Air enters through the entrance 90*a* of the slots and causes the vane 78 to engage the inner roller 79 (not shown in FIG. 5; see FIG. 4). FIG. 6 is an illustration of the relative thickness of the vane 78 and the slots 90.

FIG. 8 is a side view of the vibrator shaft 75. The small drilled holes 85 allow for the pressurized fluid to pass through and engage the vane 78 (see FIG. 4). The shoulder 81 of the shaft 75 engages the inside corners of extensions 96 of the top plate 72 and the bottom plate 73 (see FIGS. 4, 10, 12 and 14). As seen in FIG. 9, the vibrator shaft 75 includes a series of bolt holes 92 for attachment to the top plate 72 and the bottom plate 73. As seen in FIG. 10, the conduit 84 allows pressurized fluid from the pressurized fluid reservoir (not shown) to enter the shaft body 75 and pass through the small drilled holes 85 to engage the vane 78.

From FIGS. 11 and 12 it will be noted that the slots 93 allow for the escape of pressurized fluid that enters the vibrator 65 from the pressurized fluid reservoir.

FIGS. 16 and 17 illustrate the inner ring 79, sealing means 80 and groove 90. FIGS. 18 and 19 illustrate the outer ring 82. The vibrational action of the vibrator 65, and specifically the action of the rings 79 and 82, is best understood upon viewing FIGS. 20A through 20D. Air enters through the small drilled holes 85 and engages the vane 78, driving it outwardly until the left end of the vane 78, as viewed in FIG. 5, engages the inner peripheries of inner ring 79. The inner ring 79 pushes against the outer ring 82, and, because the vane slots 90 are closed on one side, the vane causes the inner, and then the outer, rings to roll around the internal surface 97 of body 74. FIGS. 21A through 21D illustrate this circular vibrating motion in a vibrator having smaller inner ring 79*a* and outer ring 82*a*.

Figure 22A:
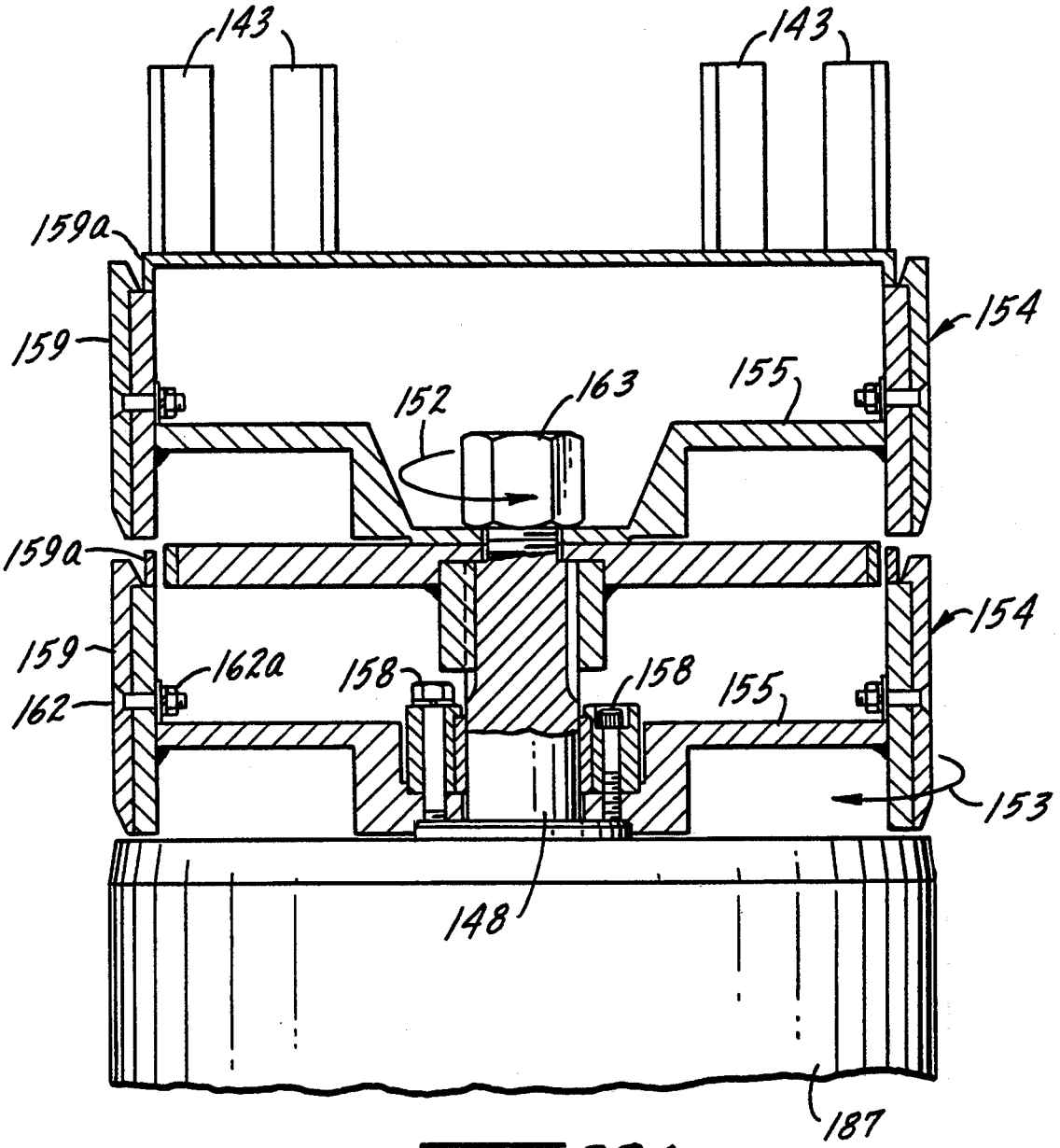
FIG. 22A is a partial sectional view showing a counter rotating packerhead with an upper longbottom assembly and a lower longbottom assembly.
Figure 22B:
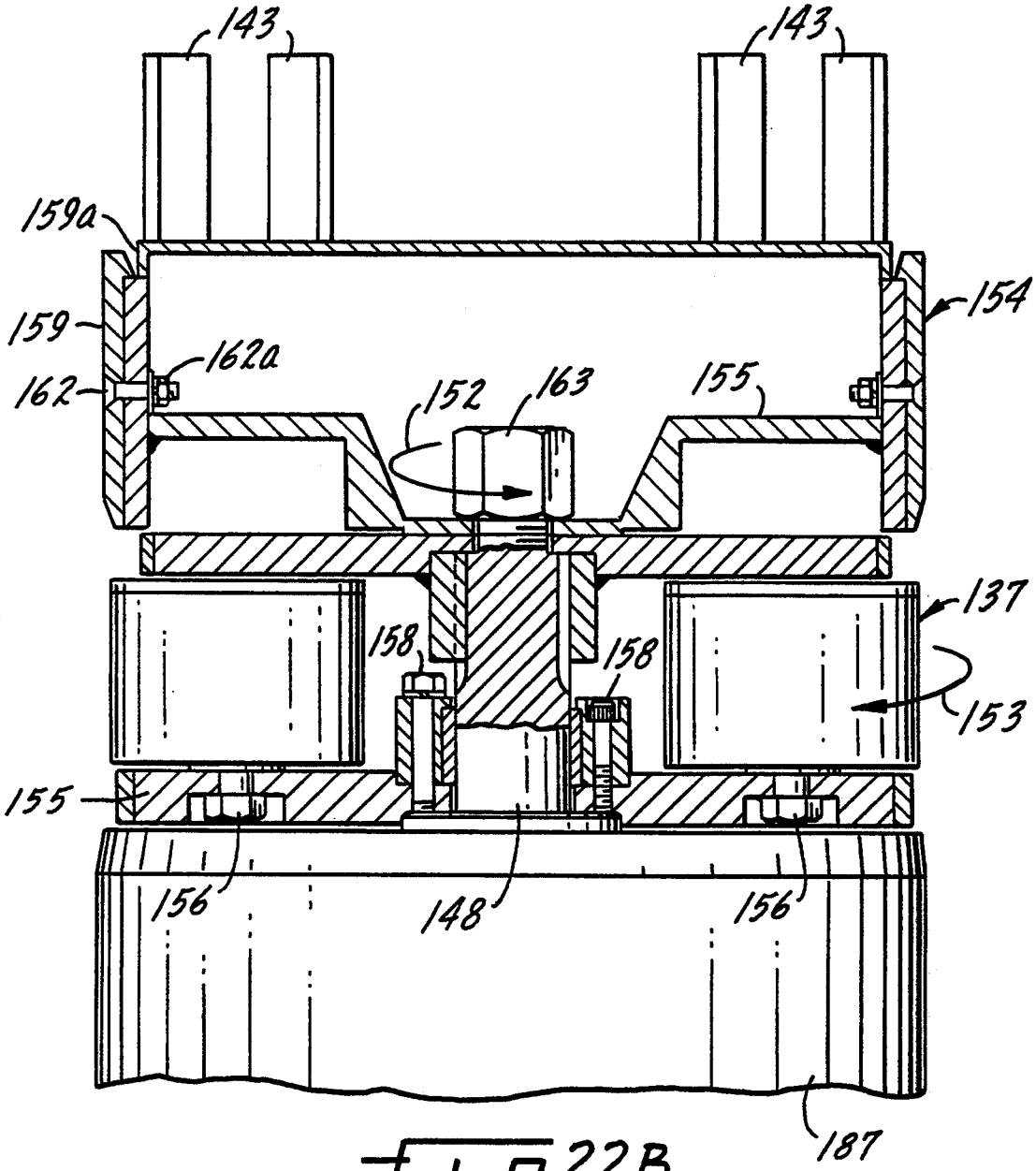
FIG. 22B is a partial sectional view showing a counter rotating packerhead with an upper longbottom assembly and lower rollerhead assembly.

FIG. 22 is an illustration of an alternative embodiment. The counter rotating packerhead assembly, indicated generally at 140, includes an upper set of rollers indicated generally at 145 and a lower longbottom assembly indicated generally at 154 in lieu of a lower set of rollers 54 (compare with FIG. 2). The longbottom assembly 154 is mounted to the longbottom support plate 155 which in turn is connected to the outer drive shaft by bolts 158. The wear resistant segments 159 can be replaced upon removing the screw 162 and nut 162*a*. Abrasion resistant wear bands 159*a* help prevent dry cast concrete from entering the inner workings of the counter rotating packerhead 140. The vibrating core shown at 187 is analogous to that shown at 87 in FIG. 2. FIG. 22A is yet another alternative embodiment illustrating the use of upper and lower longbottom assemblies. FIGS. 22B is still another alternative embodiment illustrating the use of an upper longbottom assembly and lower roller assembly.

Thus, an improved packerhead and vibrator assembly is provided for improved quality pipe which can be made at a rate much faster than the rate at which vibrated pipe is currently made. The unique annular vibrator allows the vibrator to be disposed closer to the packerhead than known heretofore. The drive means for the assembly is now disposed safely below the vibrator and is protected from the vibrations imparted to the core by the vibrator. The disclosed design is mechanically more reliable and produces quality pipe faster than designs previously available.

Although only two preferred embodiments of the present invention have been illustrated and described, it will at once be apparent to the those skilled in the art that variations may be made within the spirit and scope of the invention. Accordingly, it is intended that the scope of the invention be limited solely by the scope of the hereafter appended claims and not by any specific wording in the foregoing description.

We claim:

1. An improved combination counter rotating packerhead and vibrating core assembly for a concrete pipe making machine, the assembly comprising:

an upper concrete forming assembly for initially distributing dry cast concrete radially outward against a mold, the upper concrete forming assembly being rotatably mounted to an upper drive means, the upper drive means rotating the upper concrete forming assembly in a first direction, a lower concrete forming assembly for secondary distribution of the dry cast concrete radially outward against the mold, the lower concrete forming assembly being rotatably mounted to a lower drive means, the lower drive means rotating the lower concrete forming assembly in a second direction, the second direction being opposite to the first direction, the upper drive means and the lower drive means including separate drive shafts, the drive shafts being coaxial, a vibrator assembly located beneath the lower concrete forming assembly, an isolation section disposed between the vibrator assembly and the lower concrete forming assembly, the isolation section comprising a bearing mounted on rubber bushings, the bearing being connected to the vibrator assembly, and the rubber bushings being connected to the lower concrete forming assembly, the drive shafts extending through the isolation section and the vibrator assembly.

2. The assembly of claim 1, wherein the vibrator contains no bearings.

3. The assembly of claim 1, wherein the upper and lower concrete forming assemblies are roller assemblies.

4. The assembly of claim 1, wherein the upper concrete forming assembly is a roller assembly and the lower concrete forming assembly is a longbottom assembly.

5. The assembly of claim 1, wherein the upper concrete forming assembly is a longbottom assembly and the lower concrete forming assembly is a roller assembly.

6. The assembly of claim 1, further including a means for supplying power to the upper and lower drive means, the means for supplying power to the upper and lower drive means being disposed below the vibrator.

7. The assembly of claim 1, wherein at least the upper concrete forming assembly includes a plurality of rollers, each roller having an outer surface for distributing dry cast concrete radially outward, the outer surface being coated with replaceable wear material, whereby the rollers may be re-coated with new replaceable wear material after extended use.

8. An improved combination counter rotating packerhead and vibrating core assembly for a concrete pipe making machine, the assembly comprising:

an upper concrete forming assembly for initially distributing dry cast concrete radially outward against a mold, the upper concrete forming assembly being rotatably mounted to an upper drive means, the upper drive means rotating the upper concrete forming assembly in a first direction, a lower concrete forming assembly for secondary distribution of the dry cast concrete radially outward against the mold, the lower concrete forming assembly being rotatably driven by a lower drive means, the lower drive means rotating the lower concrete forming assembly in a second direction, the second direction being opposite to the first direction, the upper drive means and the lower drive means including separate drive shafts, the drive shafts being coaxial, the lower concrete forming assembly being disposed above a core, the core having an upper end, the upper end of the core carrying a vibrator for vibrating the dry cast concrete and carrying an isolation section for isolating the upper and lower concrete forming assemblies from the vibrator, the isolation section being disposed between the lower concrete forming assembly and the vibrator, the vibrator having an annular configuration, each drive shaft passing through the vibrator.

9. The assembly of claim 8, wherein the vibrator contains no bearings.

10. The assembly of claim 8, wherein the upper concrete forming assembly is a roller assembly.

11. The assembly of claim 8, wherein the lower concrete forming assembly is a roller assembly.

12. The assembly of claim 8, wherein the upper concrete forming assembly is a longbottom assembly.

13. The assembly of claim 8, wherein the lower concrete forming assembly is a longbottom assembly.

14. The assembly of claim 8, further including means for supplying power to the upper and lower drive means, the means for supplying power to the upper and lower drive means being disposed below the vibrator.

15. The assembly of claim 8, wherein at least the upper concrete forming assembly includes at least one outer surface for distributing dry cast concrete radially outward, the outer surface being coated with replaceable wear material, whereby the outer surface may be re-coated with new replaceable wear material after extended use.

16. The assembly of claim 8, wherein the isolation section includes bearing means mounted on rubber bushings to isolate the lower concrete forming assembly from the vibrator, the bearing means being connected to the vibrator, and the rubber bushings being connected to the lower concrete forming assembly.

17. A high speed method of making reinforced concrete pipe, the method comprising the steps of:

traversing a combination counter rotating packerhead and vibrating core assembly upward through a reinforcing wire cage located within a concrete pipe mold while dry cast concrete is being poured into the concrete pipe mold, applying a first radially outward force to the dry cast concrete while the packerhead and core assembly transverses through the cage, the first radially outward force being applied by rotating an upper concrete forming assembly of the packerhead and core assembly in a first direction to force the dry cast concrete into the reinforcing wire cage and against the concrete pipe mold, the upper concrete forming assembly being disposed at the upper end of the combination counter rotating packerhead and vibrating core assembly, applying a second radially outward force to the dry cast concrete while the packerhead and core assembly transverses through the cage, the second radially outward force being applied by rotating a lower concrete forming assembly of the packerhead and core assembly in a second direction to further force the dry cast concrete into the reinforcing wire cage and against the concrete pipe mold, the second direction being opposite to the first direction so that any twist tended to be applied to the reinforcing cage imposed by rotating the upper concrete forming assembly in the first direction is counteracted by rotating the lower concrete forming assembly in the second, opposite direction, the lower concrete forming assembly being disposed immediately below the upper concrete forming assembly, isolating the upper and lower concrete forming assemblies from vibrations imparted by a vibrator of the packerhead and core assembly with an isolation section of the packerhead and core assembly disposed between the lower concrete forming assembly and the vibrator while the packerhead and core assembly transverses through the cage, vibrating the dry cast concrete with the vibrator and a core skin of the packerhead and core assembly while the packerhead and core assembly transverses through the cage, the vibrator being mounted on the core skin, the vibrator and core skin being disposed below and in juxtaposition to the lower concrete forming assembly, the first and second radially outward forces imparted by the upper and lower concrete forming assemblies being supplied by a drive means disposed through the vibrator.

18. A high speed method of making reinforced concrete pipe, the method comprising the steps of:

traversing a combination counter rotating packerhead and vibrating core assembly through a reinforcing wire cage located within a concrete pipe mold while dry cast concrete is being poured into the concrete pipe mold, applying a first radially outward force to the dry cast concrete while the packerhead and core assembly transverses through the cage, the first radially outward force being applied by rotating an upper concrete forming assembly of the packerhead and core assembly in a first direction to force the dry cast concrete into the reinforcing wire cage and against the concrete pipe mold, applying a second radially outward force to the dry cast concrete while the packerhead and core assembly transverses through the cage, the second radially outward force being applied by rotating a lower concrete forming assembly of the packerhead and core assembly in a second direction to further force the dry cast concrete into the reinforcing wire cage and against the concrete pipe mold, the second direction being opposite to the first direction so that any twist tended to be applied to the reinforcing cage imposed by rotating the upper concrete forming assembly in the first direction is counteracted by rotating the lower concrete forming assembly in the second direction, vibrating the dry cast concrete with a vibrator of the packerhead and core assembly while the packerhead and core assembly transverses through the cage, the vibrator being annular in shape and disposed below the lower concrete forming assembly, the first and second radially outward forces being supplied by a drive means disposed below the vibrator, the drive means being connected to the upper and lower concrete forming assemblies by coaxial drive shafts, the drive shafts passing through the vibrator.

* * * * *